US009844972B2

(12) United States Patent
Park

(10) Patent No.: US 9,844,972 B2
(45) Date of Patent: Dec. 19, 2017

(54) WRITING AND UNDERLINE-DRAWING IMPLEMENT

(71) Applicant: Yong Gwang Park, Gyeongsangnam-do (KR)

(72) Inventor: Yong Gwang Park, Gyeongsangnam-do (KR)

( * ) Notice: Subject to any disclaimer, the term of this patent is extended or adjusted under 35 U.S.C. 154(b) by 0 days.

(21) Appl. No.: 15/101,775

(22) PCT Filed: May 12, 2015

(86) PCT No.: PCT/KR2015/004723
§ 371 (c)(1),
(2) Date: Jun. 3, 2016

(87) PCT Pub. No.: WO2015/174713
PCT Pub. Date: Nov. 19, 2015

(65) Prior Publication Data

US 2016/0303890 A1 Oct. 20, 2016

(30) Foreign Application Priority Data

May 13, 2014 (KR) ..... 10-2014-0057065
Dec. 1, 2014 (KR) ..... 10-2014-0169401

(51) Int. Cl.

| | |
|---|---|
| ***B05C 1/00*** | (2006.01) |
| ***B43K 7/00*** | (2006.01) |
| ***B43K 17/00*** | (2006.01) |
| ***B43K 23/08*** | (2006.01) |
| ***B43K 24/08*** | (2006.01) |

(Continued)

(52) U.S. Cl.
CPC ..... *B43K 7/00* (2013.01); *B43K 7/005* (2013.01); *B43K 8/003* (2013.01); *B43K 17/00* (2013.01); *B43K 23/08* (2013.01); *B43K 24/08* (2013.01); *B43K 24/163* (2013.01); *B43K 27/08* (2013.01); *B43K 29/00* (2013.01)

(58) Field of Classification Search
CPC ..... B43K 24/00; B43K 24/10; B43K 24/16; B43K 27/02; B43K 27/08; B43K 27/12; B43K 29/00; B43K 29/004; B43K 29/08; B43K 29/18
USPC ..... 401/17
See application file for complete search history.

(56) References Cited

U.S. PATENT DOCUMENTS 5,309,643 A * 5/1994 McCollom ..... B26B 29/06 15/437
2016/0347110 A1* 12/2016 Chiu ..... B43K 29/00

FOREIGN PATENT DOCUMENTS

JP S49-9346 U 1/1974
JP S58-9795 U1 1/1983

(Continued)

*Primary Examiner* — Jennifer C Chiang
(74) *Attorney, Agent, or Firm* — KORUS Patent, LLC; Seong Il Jeong

(57) ABSTRACT

A writing and underline-drawing implement includes: an elongate hollow body having an open top portion and a closed bottom portion; an elongate core received in the elongate hollow body, the elongate core having the tip portion; a cap having a tip hole partially formed in a top portion thereof, the cap being hollow and having an open bottom portion to partially receive and/or passed through by the elongate core, the cap being configured to at least partially move along a length of the elongate hollow body; and rotatable guide wheels coupled to the cap at an upper portion of the cap, the cap being disposed between the guide wheels.

22 Claims, 13 Drawing Sheets

(51) Int. Cl.

| | |
|---|---|
| ***B43K 29/00*** | (2006.01) |
| ***B43K 8/00*** | (2006.01) |
| ***B43K 24/16*** | (2006.01) |
| ***B43K 27/08*** | (2006.01) |

(56) References Cited

FOREIGN PATENT DOCUMENTS

| | | | |
|---|---|---|---|
| JP | S63-23088 | U | 2/1988 |
| JP | H04-17992 | U | 2/1992 |
| JP | 2010-247349 | A | 11/2010 |

* cited by examiner

WRITING AND UNDERLINE-DRAWING IMPLEMENT

BACKGROUND

Field of the Present Disclosure

The present disclosure relates to a writing and underline-drawing implement, and, more particularly, to a writing and underline-drawing implement to allow an underline to be drawn in a straight line with improved straightness.

Discussion of the Related Art

Conventionally, in order to draw an underline in a straight line, a separate elongate straight object, such as, a ruler may be used.

The convention approach brings the separate elongate straight object onto the note or paper and remove the object after completion of the drawing the line. Thus, this may prevent in-depth studies. Without the separate elongate straight object, this disallows an underline to be drawn in a straight line with improved straightness.

PRIOR ART DOCUMENTS

Patent Documents

Patent document 1: Korean utility model registration number 20-0460052 (Apr. 20, 2012)

Patent document 2: Korean utility model application publication number 20-2013-0000228 (Jan. 9, 2013)

Patent document 3: Korean patent number 10-0734903 (Jun. 27, 2007)

SUMMARY

From considerations of the above situations, the present disclosure provides a writing and underline-drawing implement to allow the user to quickly draw an underline in a straight line with improved straightness without the separate elongate straight object.

In an aspect of the present disclosure, there is provided a writing and underline-drawing implement comprising an upper elongate hollow body having an open top portion and a closed bottom portion; a lower elongate hollow body coupled to the upper hollow body, the lower elongate hollow body having a first tip hole; a primary elongate core received in the lower hollow body, the primary elongate core having a first tip portion; a secondary elongate core received in the upper elongate hollow body, the secondary elongate core having the second tip portion, wherein the secondary elongate core has a bottom portion contacting the bottom portion of the upper body; a cap having a second tip hole partially formed in a top portion thereof, the cap being hollow and having an open bottom portion to partially receive and/or passed through by the secondary elongate core, the cap being inserted into the top portion of the upper elongate hollow body, the cap being configured to at least partially move along a length of the upper elongate hollow body; and rotatable guide wheels coupled to the cap at an upper portion of the cap, the cap being disposed between the guide wheels, wherein the secondary elongate core is configured such that the second tip portion passes through and beyond the second tip hole out of the cap when the cap is further inserted in the upper elongate hollow body by a predetermined distance, thereby to reach an underline-drawing mode where when the guide wheels contact and run on a paper, the second tip portion draws a straight line on the paper.

In an aspect of the present disclosure, there is provided a writing and underline-drawing implement comprising an elongate hollow body having an open top portion and a closed bottom portion; an elongate core received in the elongate hollow body, the elongate core having the tip portion; wherein the elongate core has a bottom portion spaced from the bottom portion of the body; a cap having a tip hole partially formed in a top portion thereof, the cap being hollow and having an open bottom portion to partially receive and/or passed through by the elongate core, the cap being inserted into the top portion of the elongate hollow body, the cap being configured to at least partially move along a length of the elongate hollow body; and rotatable guide wheels coupled to the cap at an upper portion of the cap, the cap being disposed between the guide wheels, wherein the elongate core is configured such that the tip portion passes through and beyond the tip hole out of the cap when the cap is further inserted in the elongate hollow body by a predetermined distance, thereby to reach an underline-drawing mode where when the guide wheels contact and run on a paper, the tip portion draws a straight line on the paper.

In accordance with the above writing and underline-drawing implement, following effects may be realized. Both the writing and underline-drawing modes may be realized in a single pen. This may improve in-depth studies due to the fact that it may dispense the separate elongate straight object. Further, the present writing and underline-drawing implement may allow the user to quickly draw an underline in a straight line with improved straightness without the separate elongate straight object.

BRIEF DESCRIPTIONS OF THE DRAWINGS

Figure 1:
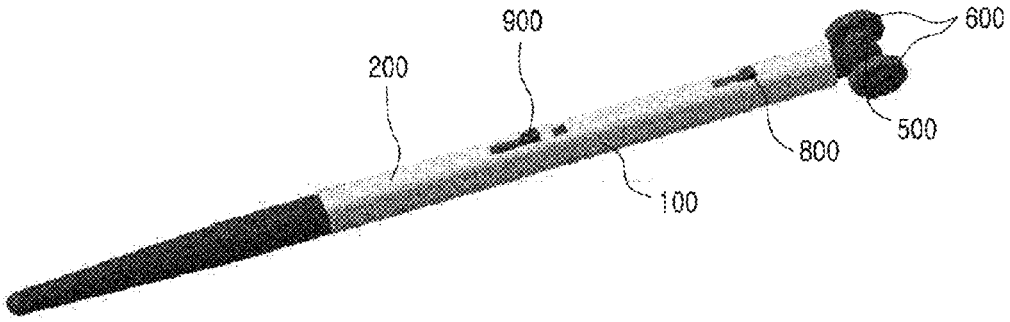
FIG. 1 and FIG. 2 show respectively perspective views of writing and underline-drawing implements respectively in accordance with a first embodiment and fourth embodiment of the present disclosure.

| Reference numerals | |
|---|---|
| 100: upper hollow body | 120: elongate stopper hole |
| 120a: upper elongate stopper hole | 120b: lower elongate stopper hole |
| 130: isolator | 140: spring support |
| 150: body protrusion | 160: position limiter protrusion |
| 200: lower hollow body | 300: primary elongate core |
| 400: secondary elongate core | 420: the second tip portion |
| 430: second stopper protrusion | 500: cap |
| 520: cap protrusion | 600: guide wheels |
| 610: wheel shafts | 700: spring |
| 700a: upper spring | 700b: lower spring |
| 710: supporter | 720: coupling protrusion |
| 800: stopper | |

DETAILED DESCRIPTIONS

Hereinafter, embodiments of the present disclosure will be described in details with reference to attached drawings.

Figure 2:
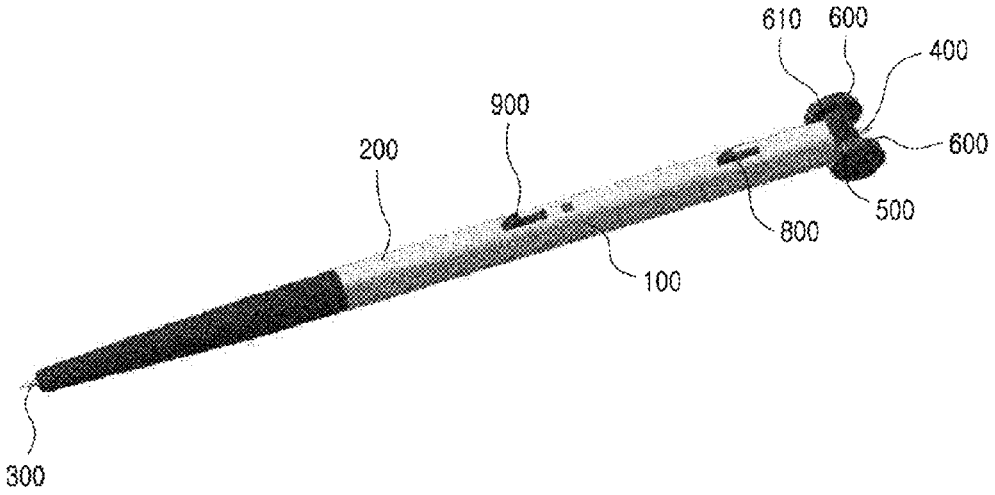
Figure 3:
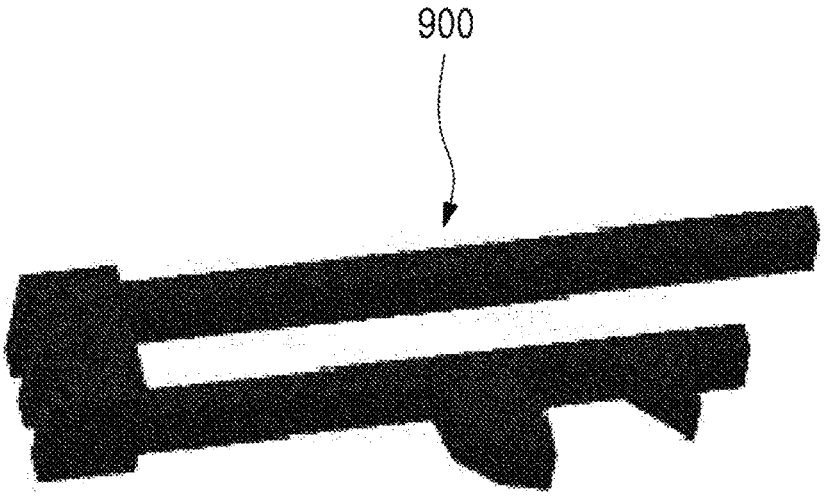
FIG. 3 shows a perspective view of an elongate-core controller of a writing and underline-drawing implement in accordance with a first embodiment and fourth embodiment of the present disclosure.

FIG. 1 and FIG. 2 show respectively perspective views of writing and underline-drawing implements respectively in accordance with a first embodiment and fourth embodiment of the present disclosure. FIG. 3 shows a perspective view of an elongate-core controller of a writing and underline-drawing implement in accordance with a first embodiment and fourth embodiment of the present disclosure.

Referring to FIG. 1 to FIG. 3, a present writing and underline-drawing implement may include an upper hollow body 100, a lower hollow body 200, a primary elongate core 300, a secondary elongate core 400, a cap 500, guide wheels 600, wheel shafts 610, a spring 700, a stopper 800 and an elongate-core controller 900. As used herein, the term "core" may refer to a material to be used for writing or drawing the line, for example, an ink or graphite, etc.

The upper hollow body 100 and lower hollow body 200 may be coupled to each other at opposing ends thereof to form a single elongate linear body.

The upper hollow body 100 and lower hollow body 200 may have upper and lower inner spaces defined therein, which may be isolated from each other via an isolator 130.

The lower hollow body 200 may have lower and upper portions detachably coupled to each other using a screw coupling. The lower portion of the lower hollow body 200 may taper toward the bottom thereof and may have a first tip hole formed in the bottom to allow entrance and exit of the primary elongate core 300.

In the lower hollow body 200, a primary elongate core 300 such as a ball-pen ink source core may be disposed. Within the lower hollow body 200 and between a protrusion from a bottom of the primary elongate core 300 and the bottom of the lower hollow body 200, an elastic member may be disposed. The elongate-core controller 900 abutting to a top of the primary elongate core 300 may be disposed in an upper portion of the lower hollow body 200.

In one upper side face of the lower hollow body 200, two holes may be vertically-spacedly disposed. The elongate-core controller 900 may have two protrusions horizontally protruding therefrom which may be vertically-spacedly disposed. The two protrusions of the elongate-core controller 900 may vertically move and also move inwardly and outwardly in and from the body in an elastic manner. Thus, when the lower protrusion of the elongate-core controller 900 is engaged with the lower hole of the lower hollow body 200 and the upper protrusion of the elongate-core controller 900 is engaged with the upper hole of the lower hollow body 200, the elongate-core controller 900 may be in a raised state such that the inner elastic member may push upwards the primary elongate core 300 which may be entirely concealed in the lower hollow body 200.

Otherwise, the upper protrusion of the elongate-core controller 900 is pushed down to be disengaged with the upper hole of the lower hollow body 200, and then, the upper protrusion of the elongate-core controller 900 may be engaged with the lower hole of the lower hollow body 200. That is, both the upper and lower protrusions of the elongate-core controller 900 may be engaged with the lower hole of the lower hollow body 200. Thus, the primary elongate core 300 may be lowered down such that the bottom or tip portion of the primary elongate core 300 may extend out of the lower hollow body 200, thereby to achieve a writing mode.

The above configuration related to the primary elongate core 300, lower hollow body 200 and primary elongate core 300 may be conventional. Thus, more details about the same may be omitted herein.

Further, a configuration of the lower hollow body 200 and primary elongate core 300 may be not limited to the above configuration, for example, including the controller 900. For example, the configuration of the lower hollow body 200 and primary elongate core 300 may have any configuration applied to a conventional ball pen, sign-pen, sharp-pencil, pencil, etc. as well-known to the skilled person to the art.

A configuration including the upper hollow body 100, secondary elongate core 400, cap 500, guide wheels 600 etc. may act as an underline-drawing implement. In use, in a writing mode, while the upper hollow body 100 faces upwards, the primary elongate core 300 may be used to write the content. In an underline-drawing mode, while the upper hollow body 100 faces the paper and the lower hollow body 200 faces upward, the secondary elongate core 400 may be used.

On one side face of the upper hollow body 100, the elongate stopper hole 120 may extend vertically. A first stopper protrusion 810 of the stopper 800 may pass through the elongate stopper hole 120 and may vertically move along and in the vertically elongate stopper hole 120.

The upper hollow body 100 may have an open top portion and may receive therein the secondary elongate core 400. As used herein, the inner space of the upper hollow body 110 receiving the secondary elongate core 400 may be referred to as a "secondary elongate core space". A cap 500 may have a core tip hole (or second tip hole) at a top thereof at a center and may have an open bottom portion. Into the open top portion of the upper hollow body 100, the cap may partially move vertically. As used herein, the inner space of the cap 550 may be referred to as a "cap inner space".

The secondary elongate core 400 in accordance with a first embodiment, second embodiment and third embodiment may be embodied as a conventional ball pen core or pencil core. The secondary elongate core 400 may be disposed in the secondary elongate core space and cap inner space. By a distance by which the cap 500 is inserted into the secondary elongate core space, a tip portion of the secondary elongate core 400 may pass through and beyond the second tip hole out of the cap 500. The secondary elongate core 400 itself may be fixed in a position. Rather, the cap 500 may vertically move down to allow a tip portion of the secondary elongate core 400 to pass through and beyond the second tip hole out of the cap or vertically move up to allow a tip portion of the secondary elongate core 400 to pass through and beyond the second tip hole into the cap 500.

Distant from the tip portion of the secondary elongate core 400 at a given distance, a second stopper protrusion 430 may be formed on the secondary elongate core 400. A coil spring 700 may be passed through by the secondary elongate core 400. The coil spring 700 may have a bottom thereof contacting the second stopper protrusion 430 and may have a top contacting the top of the cap 500. When the cap 500 is pushed down, the coil spring 700 may be compressed.

Figure 4:
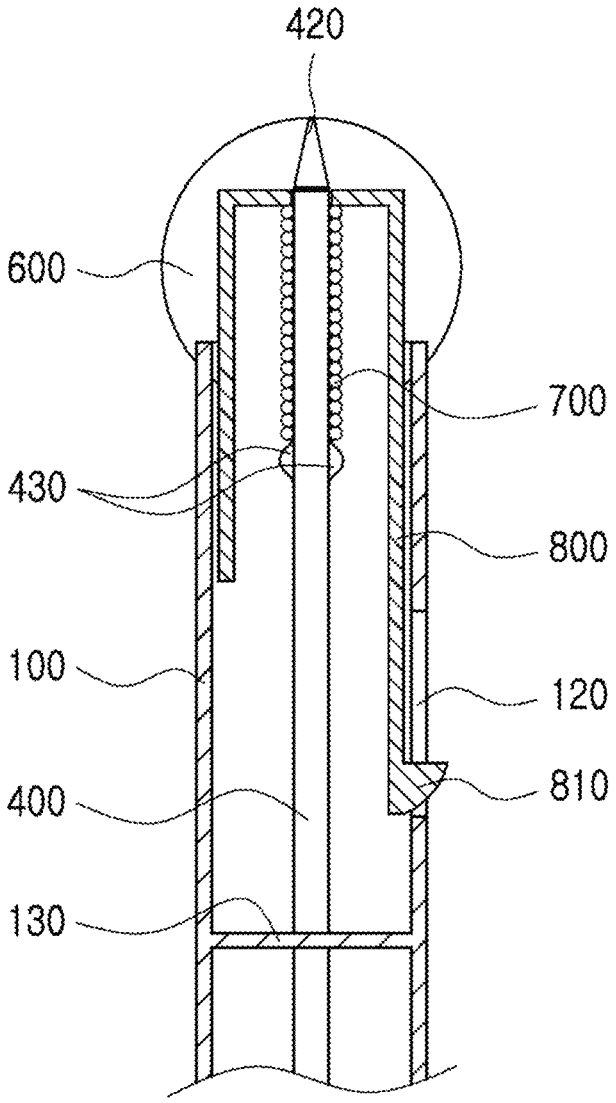
FIG. 4 shows a cross-sectional view of an underline-drawing module of a writing and underline-drawing implement in accordance with a first embodiment of the present discourse.

The stopper 800 may extend downwardly to be coupled to a bottom end of the cap 500. The stopper 800 may move vertically in a spring-loaded manner. The stopper 800 may have a first stopper protrusion 810 projecting from a bottom end thereof. In one example, as shown in FIG. 4, the first stopper protrusion 810 may have a top portion with a right-angled inner step and a downward-tapered outer step. The first stopper protrusion 810 may be inwardly or outwardly move in an elastic manner.

When the cap 500 move upwards and thus the right-angled inner step of the first stopper protrusion 810 contacts a top edge of the elongate stopper hole 120, the cap 500 may stop there. Thus, normally, the cap 500 may not be removed from the upper body 100. Otherwise, the first stopper protrusion 810 is moved inwardly using a sharp object into the upper hollow body 100, and, at this state, the cap 500 may be pulled upwards to remove the cap 500 from the upper body. In this way, the secondary elongate core 400 may be replaced.

To both opposing side faces of an upper portion of the cap 500, two wheel shafts 610 may be coupled respectively. In this connection, the two wheel shafts 610 may extend in the same straight line or not. To ends of the wheel shafts 610, two guide wheels 600 may be coupled respectively to be rotatable.

Sizes of the guide wheels 600 may be configured such that while the guide wheels 600 contact the paper face, the cap 500 may be further inserted into the upper body by a certain distance, thereby to allow the tip portion of the secondary elongate core 400 to contact the paper face.

A material of the guide wheels 600 may be selected such that the guide wheels 600 may not slip along the paper to disallow drawing of a straight line. In this connection, factors to allow the guide wheels 600 to run in a straight line may include, for example, the wheel material being made of a rubber material with a high friction level; the wheel having an outer portion with small grooves formed along the outer portion to increase a friction force against the paper; an operation of running the wheel while pushing down the cap to increase a friction force against the paper; a suppression of the lateral movement of the wheel; a centering of the tip portion of the secondary core while contacting the paper, etc.

The present underline-drawing implement in accordance with the first embodiment, second embodiment and third embodiment will be described in details below in terms of an operation thereof.

FIG. 4 shows a cross-sectional view of an underline-drawing module of a writing and underline-drawing implement in accordance with the first embodiment of the present discourse. As shown in FIG. 4, in the first embodiment, in a writing mode, a writing module (not shown) including the lower hollow body 200 and primary elongate core 300 may be used to write the content. Then, in an underline-drawing mode, the upper hollow body 100 may turn upside down and the cap or guide wheels 600 may be pushed up to enable the tip portion of the secondary elongate core 400 to protrude out of the cap though the second tip hole and to contact the paper face. Then, the user may move the wheels horizontally with gripping the upper hollow body 100 and thus the two guide wheels 600 may run along with the tip portion of the secondary elongate core 400 in a straight line, thereby to draw an underline in a straight line.

After drawing the underline, the user may not push the guide wheels 600, and thus using the restoration force of the spring 700, the cap 500 may return to its original position. Thus, the tip portion of the secondary elongate core 400 may be inserted back in the inner space in the cap 500.

Figure 5:
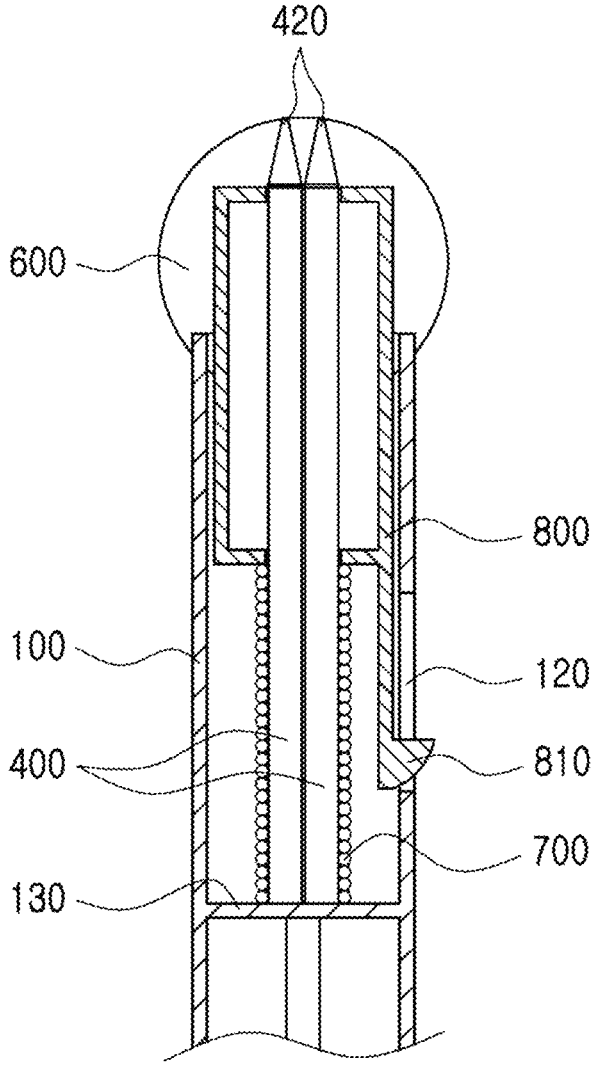
FIG. 5 shows a cross-sectional view of an underline-drawing module of a writing and underline-drawing implement in accordance with a second embodiment of the present discourse.

FIG. 5 shows a cross-sectional view of an underline-drawing module of a writing and underline-drawing implement in accordance with the second embodiment of the present discourse. As shown in FIG. 5, the second embodiment may be different from the first embodiment in that two parallel-adjacent secondary elongate cores 400 to render different colors from each other may be disposed, and the secondary elongate core 400 may not have the second stopper protrusion 430 formed thereon but rather the spring 700 may be disposed between the bottom of the cap 500 and the isolator 130 between the upper and lower bodies.

In the second embodiment, the two tip portions of the two secondary elongate cores 400 respectively may protrude out of the cap concurrently. However, when the upper hollow body 100 is tilted, only one of the two tip portions of the two secondary elongate cores 400 respectively may be used to draw one line.

Figure 6:
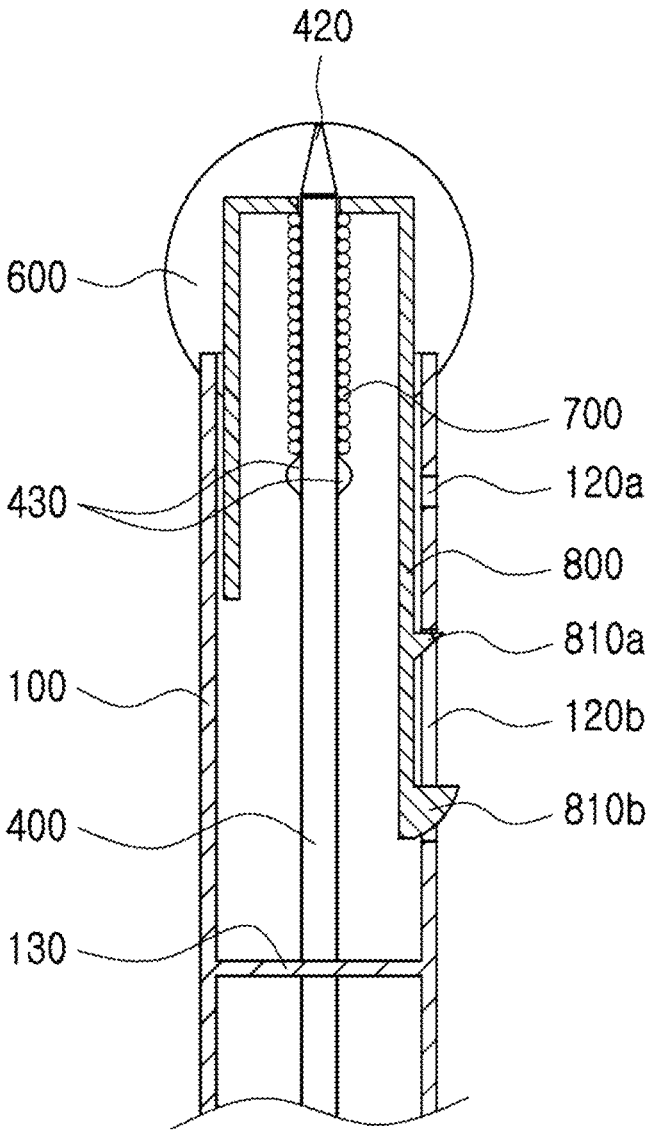
FIG. 6 shows a cross-sectional view of an underline-drawing module of a writing and underline-drawing implement in accordance with a third embodiment of the present discourse.

FIG. 6 shows a cross-sectional view of an underline-drawing module of a writing and underline-drawing implement in accordance with the third embodiment of the present discourse. As shown in FIG. 6, the third embodiment may be different from the first embodiment and second embodiment in that two elongate stopper holes are formed to be spaced vertically from each other in the side portion of the body 100, that is, the upper elongate stopper hole 120*a* and lower elongate stopper hole 120*b* are formed, and, correspondingly, the first stopper protrusion 810 includes an upper first stopper protrusion 810*a* and lower first stopper protrusion 810*b*.

In this connection, the upper first stopper protrusion 810*a* is engaged into the upper elongate stopper hole 120*a* and the lower first stopper protrusion 810*b* is engaged into the lower elongate stopper hole 120*b*. In this way, the cap 500 may move upwards and the secondary elongate core 400 may be entirely received in the cap 500 and upper hollow body 100. Otherwise, when both the upper first stopper protrusion 810*a* and lower first stopper protrusion 810*b* are engaged into the lower elongate stopper hole 120*b*, the cap 500 may move down and the tip portion of the secondary elongate core 400 may protrude out of the cap 500. This configuration may be similar to the entrance or exit of the tip portion in the first core as described above.

In accordance with the first embodiment, second embodiment and third embodiment, during drawing an underline, the user needs not pushing the guide wheels 600 down against the paper face.

In accordance with fourth to eleventh embodiments of the present disclosure as will be described in details below, in a wiring mode, the secondary elongate core 400 may be concealed in the secondary elongate core space and cap inner space, and in an underline-drawing mode, the user may push the guide wheels 600 down against the paper face and thus the cap 500 may be further pushed into the secondary elongate core space to enable the second tip portion 420 to protrude via the second tip hole out of the cap 500.

Figure 7:
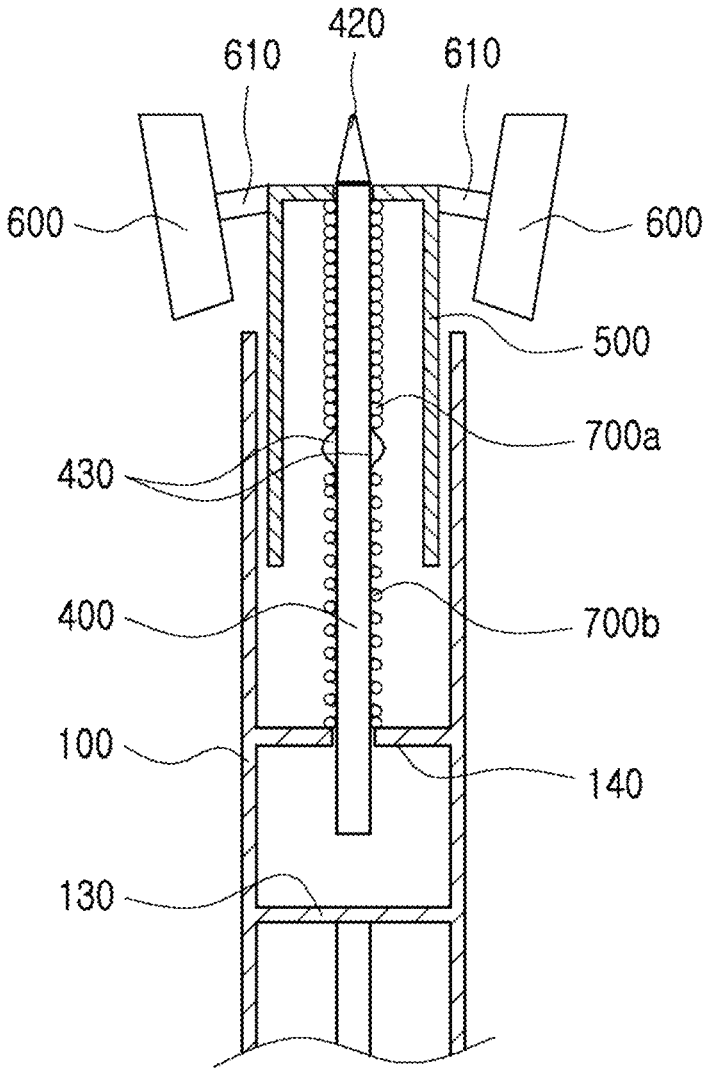
FIG. 7 shows a cross-sectional view of an underline-drawing module of a writing and underline-drawing implement in accordance with a fourth embodiment of the present discourse.

FIG. 7 shows a cross-sectional view of an underline-drawing module of a writing and underline-drawing implement in accordance with the fourth embodiment of the present discourse. As shown in FIG. 7, in the fourth embodiment, distant upwardly from the isolator 130 between the upper hollow body 100 and lower hollow body 200 at a given distance, a spring support 140 may be disposed in the upper hollow body 100. The spring support 140 may have a core hole which may be passed through by the secondary elongate core 400. The spring support 140 may have an outer edge coupled to the upper hollow body 100 at an inner periphery of the body 100. Thus, the spring support 140 may have a ring shape.

Further, in the fourth embodiment, to a side face of a portion of the secondary elongate core 400 distant downwardly from the second tip portion at a given distance, the second stopper protrusion 430 may be disposed. A coil upper spring 700*a* may be passed through by the secondary elongate core 400 and may extend between the second stopper protrusion 430 and the cap 500. The coil upper spring 700*a* may be compressed when the cap 500 is further inserted into the upper body 100. Further, a coil lower spring 700*b* may be passed through by the secondary elongate core 400 and may extend between the second stopper protrusion 430 and the isolator 130. The coil lower spring 700*b* may be compressed when the cap 500 is further inserted into the upper body 100. In this connection, the second stopper protrusion 430 and lower spring 700*b* may act to prevent the secondary elongate core 400 from moving much toward the isolator 130. The second stopper protrusion 430 and upper spring 700*a* may act to prevent the secondary elongate core 400 from moving out of the cap 500.

The secondary elongate core 400 may be configured that the bottom thereof should not contact the isolator 130 even via maximum insertion of the cap 550 into the upper body 100. Otherwise, when the secondary elongate core 400 contacts the isolator 130, a contacting force of the guide wheels 600 against the paper may be reduced to form a poor straight line because the secondary elongate core 400 is fixed in a position and only the cap 500 move in an elastic manner.

Figure 8:
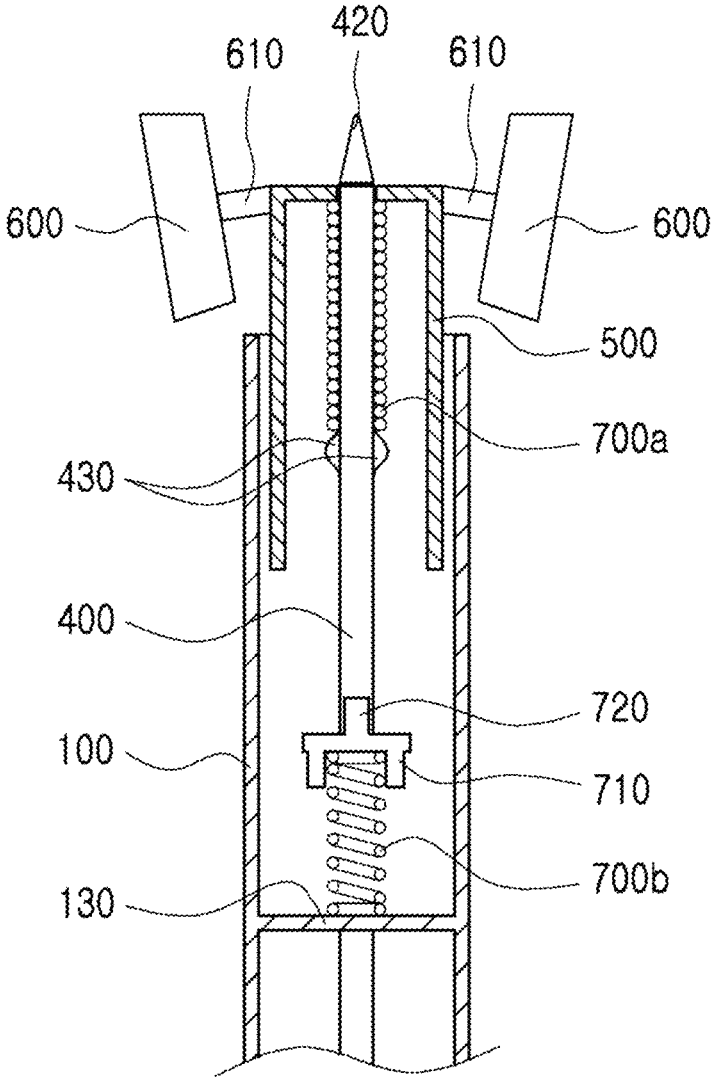
FIG. 8 shows a cross-sectional view of an underline-drawing module of a writing and underline-drawing implement in accordance with a fifth embodiment of the present discourse.

FIG. 8 shows a cross-sectional view of an underline-drawing module of a writing and underline-drawing implement in accordance with the fifth embodiment of the present discourse. As shown in FIG. 8, in the fifth embodiment, an upper spring 700*a* may be disposed between a top of the cap 500 and second stopper protrusion 430, wherein the second stopper protrusion 430 may be disposed at a given distance downwardly from the second tip portion of the secondary elongate core 400. Further, a supporter 710 may be supported by a lower spring 700*b*. The supporter 710 may have a coupling protrusion 720 extending upwardly from the supporter 710 to be fitted to a bottom groove of the secondary elongate core 400. The lower spring 700*b* may be disposed between the bottom of the supporter 710 and the isolator 130 between the upper and lower hollow body 100 and 200.

In the fifth embodiment, the secondary elongate core 400 may not contact the isolator 130 due to the lower spring 700*b* therebetween. Since the bottom hole of the secondary elongate core 400 is fitted with the coupling protrusion 720, the secondary elongate core 400 may be prevented from entirely moving out of the cap 500.

When the secondary elongate core 400 include two secondary elongate cores as shown in FIG. 5, the coupling protrusion 720 may include two coupling protrusions arranged side by side.

In the above-described fourth embodiment and fifth embodiment, while the secondary elongate core 400 is supported by the spring not to contact the isolator 130, the secondary elongate core 400 may be prevented from entirely moving out of the cap 500. In sixth to tenth embodiments as will be described later, the cap 500 may not be removed from the upper body 100 while the cap 500 may move vertically or may be fixed. Each of the fourth embodiment and fifth embodiment (two embodiments) may be applied to all of the sixth to tenth embodiments (five embodiments). Thus, combinations between the former two embodiments and the latter five embodiment may lead to ten embodiments.

Figure 9:
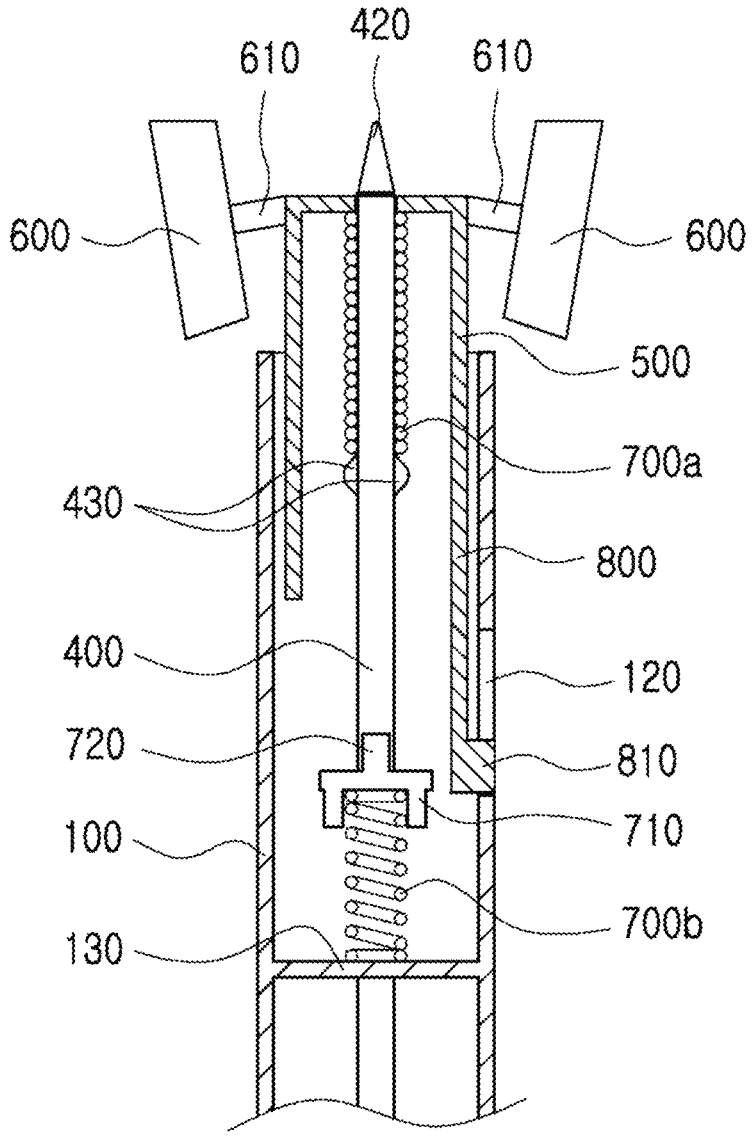
FIG. 9 shows a cross-sectional view of an underline-drawing module of a writing and underline-drawing implement in accordance with a sixth embodiment of the present discourse.

FIG. 9 shows a cross-sectional view of an underline-drawing module of a writing and underline-drawing implement in accordance with the sixth embodiment of the present discourse. As shown in FIG. 9, in the sixth embodiment, on a side face of the upper hollow body 100, an elongate stopper hole 120 may be defined vertically. The first stopper protrusion 810 of the stopper 800 may pass through the elongate stopper hole 120 and may move vertically along and in the elongate stopper hole 120.

The stopper 800 may extend downwardly to be coupled to a bottom end of the cap 500. The stopper 800 may move vertically in a spring-loaded manner. The stopper 800 may have a first stopper protrusion 810 projecting from a bottom end thereof. In one example, as shown in FIG. 9, the first stopper protrusion 810 may have a top portion with a right-angled inner step and a right-angled outer step. The first stopper protrusion 810 may be inwardly or outwardly move in an elastic manner.

When the cap 500 move upwards and thus the right-angled inner step of the first stopper protrusion 810 contacts a top edge of the elongate stopper hole 120, the cap 500 may stop there. Thus, normally, the cap 500 may not be removed from the upper body 100. Otherwise, the first stopper protrusion 810 is moved inwardly using a sharp object into the upper hollow body 100, and, at this state, the cap 500 may be pulled upwards to remove the cap 500 from the upper body. In this way, the secondary elongate core 400 may be replaced.

To both opposing side faces of an upper portion of the cap 500, two wheel shafts 610 may be coupled respectively. In this connection, each of the two wheel shafts 610 may extend in an oblique manner. To ends of the wheel shafts 610, two guide wheels 600 may be coupled respectively to be rotatable.

Sizes of the guide wheels 600 may be configured such that while the guide wheels 600 contact the paper face, the cap 500 may be further inserted into the upper body by a certain distance, thereby to allow the tip portion of the secondary elongate core 400 to contact the paper face.

A material of the guide wheels 600 may be selected such that the guide wheels 600 may not slip along the paper to disallow drawing of a straight line. In this connection, factors to allow the guide wheels 600 to run in a straight line may include, for example, the wheel material being made of a rubber material with a high friction level; the wheel having an outer portion with small grooves formed along the outer portion to increase a friction force against the paper; an operation of running the wheel while pushing down the cap to increase a friction force against the paper; a suppression of the lateral movement of the wheel; a centering of the tip portion of the secondary core while contacting the paper, etc.

In one effective approach to increase a friction force against the paper, a shaft of each of the guide wheels 600 may extend to tilt toward the upper body 100, and each of the guide wheels 600 encounters each of the wheel shafts 610 in a right angle, such that the two guide wheels 600 may be oriented not to be parallel with a length direction of the upper body 100 but be oblique relative to the length direction of the upper body 100. Specifically, a virtual extension line in an orientation direction of each wheel may encounter the upper body as shown in FIG. 9.

Further, each of the guide wheels 600 may have a truncated conical shape. The shaft of each of the guide wheels 600 may extend to tilt toward the upper body 100. In this way, the guide wheels 600 run in a straight line with more straightness.

Figure 10:
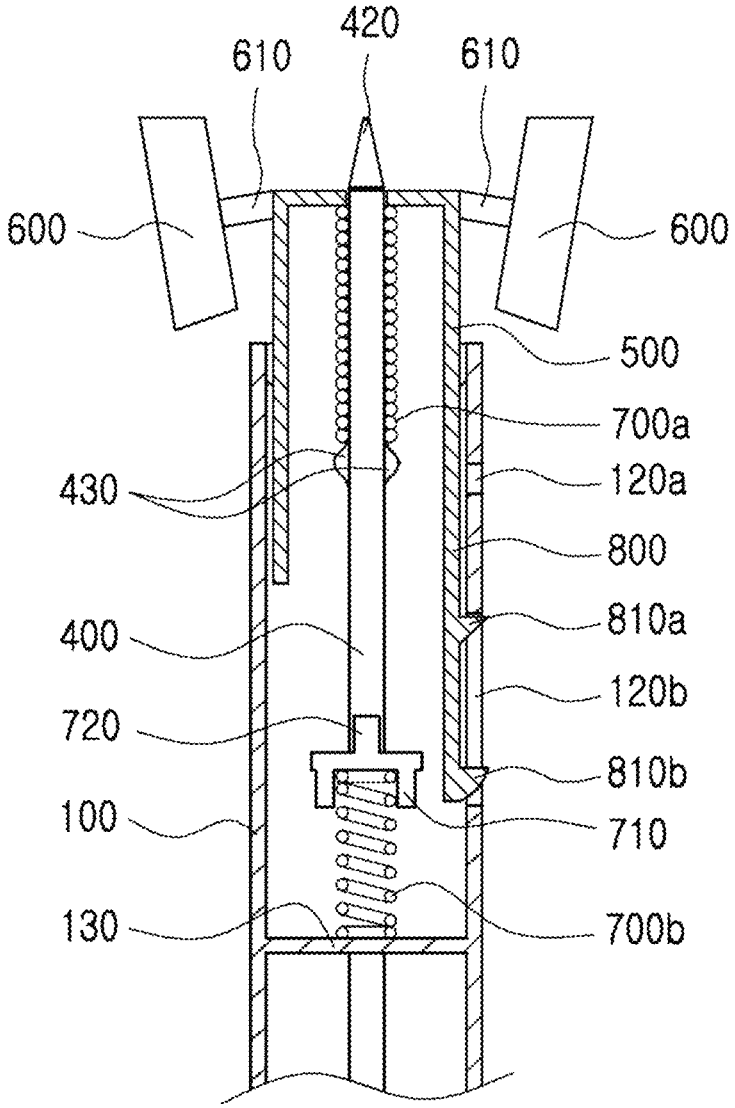
FIG. 10 shows a cross-sectional view of an underline-drawing module of a writing and underline-drawing implement in accordance with a seventh embodiment of the present discourse.

FIG. 10 shows a cross-sectional view of an underline-drawing module of a writing and underline-drawing implement in accordance with the seventh embodiment of the present discourse. As shown in FIG. 10, the seventh embodiment may be different from the sixth embodiment in that two elongate stopper holes are formed to be spaced vertically from each other in the side portion of the body 100, that is, the upper elongate stopper hole 120*a* and lower elongate stopper hole 120*b* are formed, and, correspondingly, the first stopper protrusion 810 includes an upper first stopper protrusion 810*a* and lower first stopper protrusion 810*b*.

In this connection, the upper first stopper protrusion 810*a* is engaged into the upper elongate stopper hole 120*a* and the lower first stopper protrusion 810*b* is engaged into the lower elongate stopper hole 120*b*. In this way, the cap 500 may move upwards and the secondary elongate core 400 may be entirely received in the cap 500 and upper hollow body 100. Otherwise, when both the upper first stopper protrusion 810*a* and lower first stopper protrusion 810*b* are engaged into the lower elongate stopper hole 120*b*, the cap 500 may move down and the tip portion of the secondary elongate core 400 may protrude out of the cap 500. This configuration may be similar to the entrance or exit of the tip portion in the first core as described above.

In accordance with this embodiment, whether the second tip portion 420 is in a concealed or exposed state, the second tip portion in the concealed or exposed state may be fixed in a vertical position. Thus, during drawing an underline, the user needs not pushing the guide wheels 600 down against the paper face.

Figure 11:
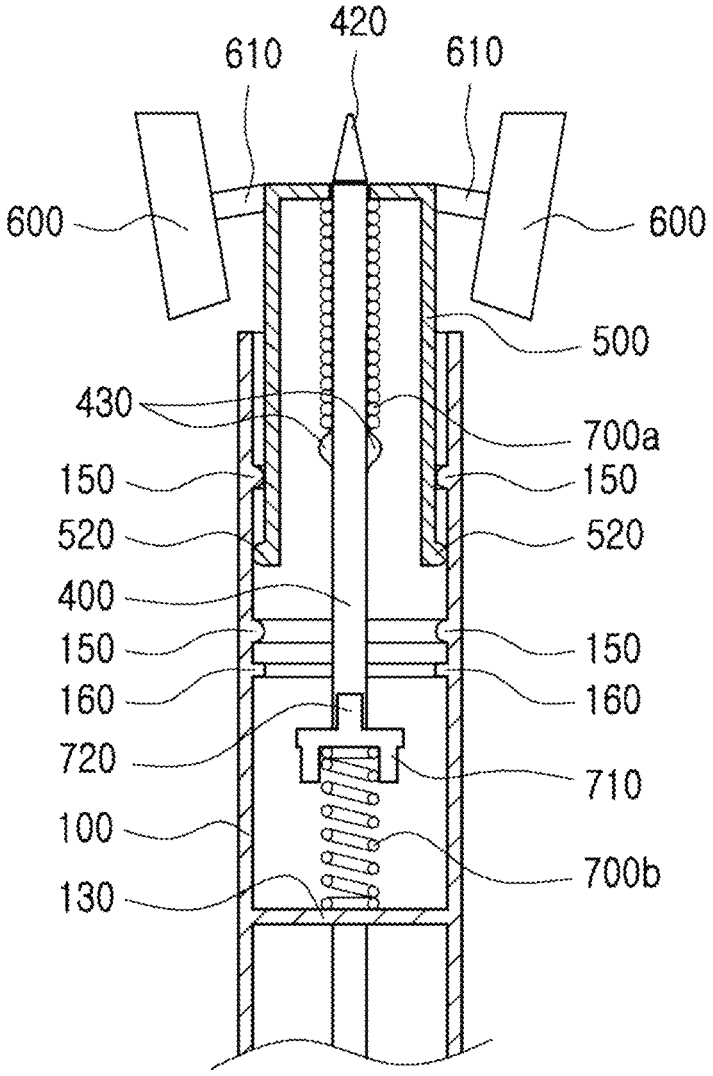
FIG. 11 shows a cross-sectional view of an underline-drawing module of a writing and underline-drawing implement in accordance with an eighth embodiment of the present discourse.

FIG. 11 shows a cross-sectional view of an underline-drawing module of a writing and underline-drawing implement in accordance with the eighth embodiment of the present discourse. As shown in FIG. 11, the eighth embodiment may be different from the sixth embodiment and seventh embodiment in that in place of the stopper 800 and first stopper protrusions 810*a* and 810*b*, a cap protrusion 520, body protrusions 150, and a position limiter protrusion 160 may be disposed.

The cap 500 may have the cap protrusion 520 disposed in a ring shape at the bottom end thereof to protrude outwardly. The upper hollow body 100 may have two body protrusions 150 formed on an inner face thereof which may be vertically spaced from each other. Each of the two body protrusions 150 may protrude inwardly in a ring shape. The upper hollow body 100 may have a position limiter protrusion 160 formed on an inner face thereof below the lower body protrusion 150 at a given distance. The position limiter protrusion 160 may protrude inwardly in a ring shape. Via application of an external force above a given degree to the cap protrusion 520 and body protrusions 150, the cap protrusion 520 overcomes the body protrusion 150 partially due to a rounded shape thereof. The position limiter protrusion 160 may stop the movement of the cap protrusion 520 partially due to an angled shape thereof. When the cap protrusion 520 is fitted between in the lower body protrusion 150 and the position limiter protrusion 160, the cap 500 may be fixed in a position while the second tip portion 420 is exposed outwardly. In other words, the cap 500 may move vertically when the cap protrusion 520 is positioned between the two body protrusion 150. In order to draw an underline, the guide wheels 600 is pushed against the paper face and thus the cap protrusion 520 is fitted between in the lower body protrusion 150 and the position limiter protrusion 160, and, hence, the cap 500 may be fixed in a vertical position. During drawing the underline, the user needs not pushing the guide wheels 600 down against the paper face.

Figure 12:
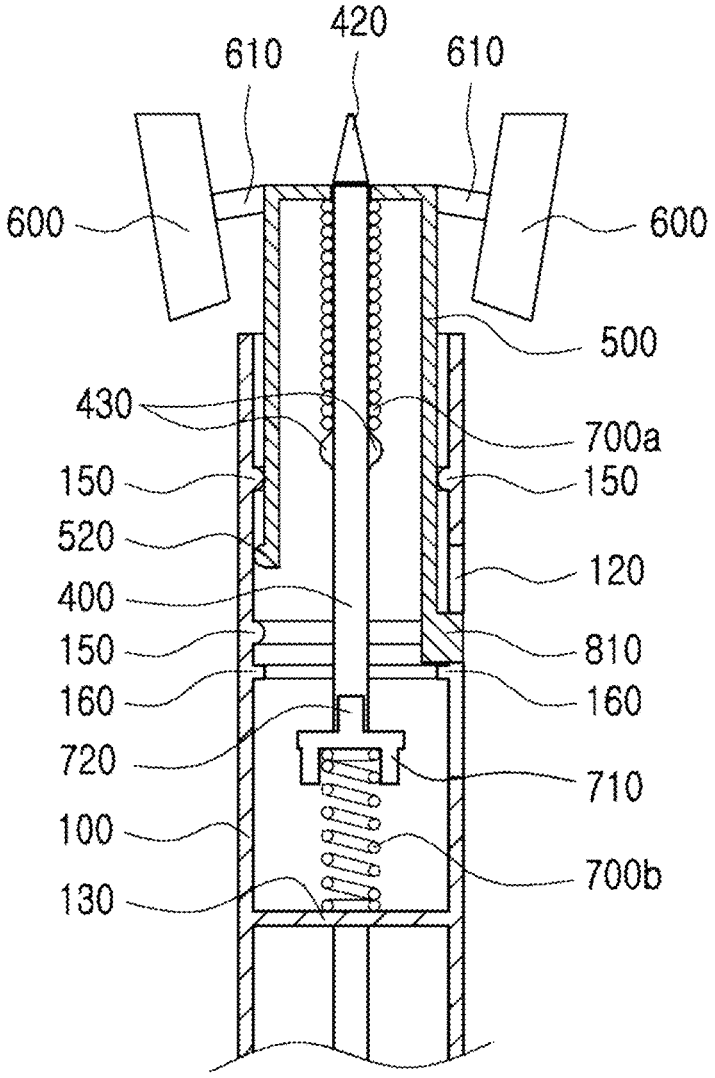
FIG. 12 shows a cross-sectional view of an underline-drawing module of a writing and underline-drawing implement in accordance with a ninth embodiment of the present discourse.

FIG. 12 shows a cross-sectional view of an underline-drawing module of a writing and underline-drawing implement in accordance with the ninth embodiment of the present discourse. As shown in FIG. 12, the ninth embodiment may be achieved by combining the sixth embodiment and eighth embodiment and removing the upper body protrusion 150 from the combination. In other words, the cap 500 may be position-fixed via the cap protrusion 520 being fitted between the lower body protrusion 150 and position limiter protrusion 160, and the cap 500 may be prevented from being removed from the upper body using the stopper 800 and first stopper protrusion 810.

Figure 13:
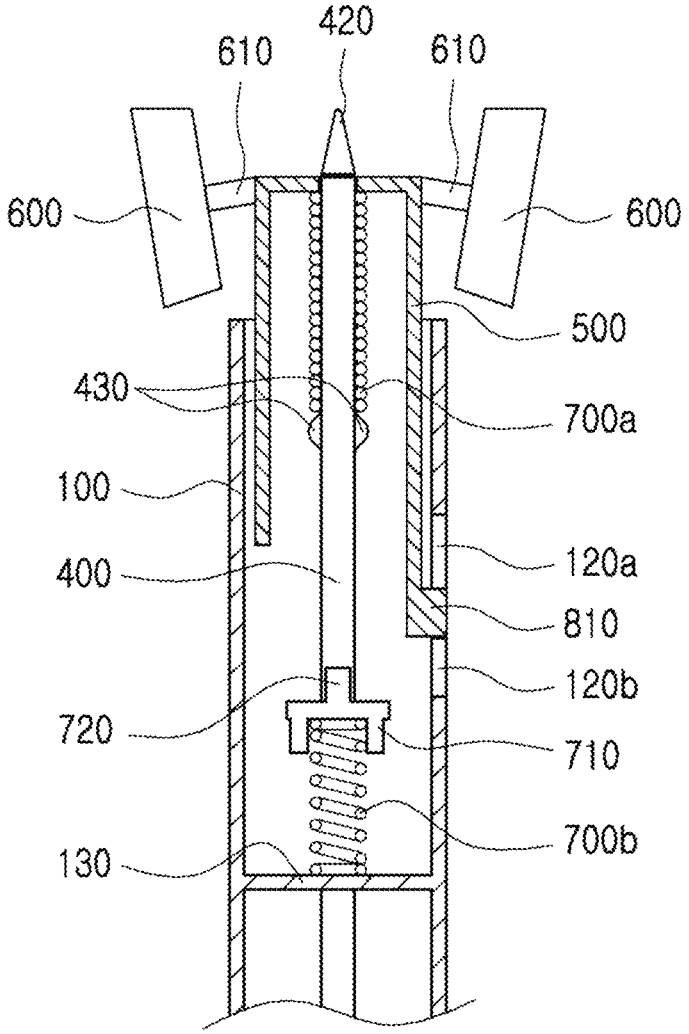
FIG. 13 shows a cross-sectional view of an underline-drawing module of a writing and underline-drawing implement in accordance with a tenth embodiment of the present discourse.

FIG. 13 shows a cross-sectional view of an underline-drawing module of a writing and underline-drawing implement in accordance with the tenth embodiment of the present discourse. As shown in FIG. 13, in the tenth embodiment, two elongate stopper holes are formed to be spaced vertically from each other in a side portion of the upper hollow body 100, that is, the upper elongate stopper hole 120*a* and lower elongate stopper hole 120*b* are formed. The stopper 800 may extend downwardly to be coupled to a bottom end of the cap 500. The stopper 800 may be integrated with the cap 500. The stopper 800 may move vertically in a spring-loaded manner. The stopper 800 may have a first stopper protrusion 810 projecting from a bottom end thereof. The first stopper protrusion 810 may move inwardly or outwardly in an elastic manner. The first stopper protrusion 810 may vertically move while engaged into the upper elongate stopper hole 120*a* and may be fixed in a position when engaged into the lower elongate stopper hole 120*b*. The first stopper protrusion 810 may protrude from the stopper 800 outwardly.

When the first stopper protrusion 810 vertically moves while engaged into the upper elongate stopper hole 120*a* and reaches a top or bottom of the upper elongate stopper hole 120*a*, the first stopper protrusion 810 may stop there, and, thus, the cap 500 also may stop there. When the first stopper protrusion 810 overcome the upper hollow body 100 and goes downs into the lower elongate stopper hole 120*b*, the first stopper protrusion 810 may stop there, and, thus, the cap 500 also may stop there.

In other words, partially due to an angled shape of both the bottom and top of the first stopper protrusion 810, when the cap 500 with the wheels is pushed against the paper face, the first stopper protrusion 810 may move down in and along the upper elongate stopper hole 120*a*, and, then, may stop at a bottom of the upper elongate stopper hole 120*a*. Via a release of the contacting force, the first stopper protrusion 810 may return to its original position due to the restoring force of the spring. However, the user may further push the cap 500 against the paper from the state in which the first stopper protrusion 810 stops at a bottom of the upper elongate stopper hole 120*a* while pushing the first stopper protrusion 810 inwardly, the first stopper protrusion 810 may be engaged into the lower elongate stopper hole 120*b* and thus the first stopper protrusion 810 stops there. In this state and is fixed in a position. In this fixed state, during drawing the underline, the user needs not pushing the guide wheels 600 down against the paper face.

A principal operation of the fourth embodiment to tenth embodiment will be describe as follows:

In a writing mode, a writing module including the lower hollow body 200 and primary elongate core 300 may be used to write the content. In an underline-drawing mode, the upper hollow body 100 may turn upside down and the cap or guide wheels 600 may be pushed up to enable the tip portion of the secondary elongate core 400 to protrude out of the cap though the second tip hole and to contact the paper face. Then, the user may move the wheels horizontally with gripping the upper hollow body 100 and thus the two guide wheels 600 may run along with the tip portion of the secondary elongate core 400 in a straight line, thereby to draw an underline in a straight line.

After drawing the underline, the user may not push the guide wheels 600, and thus using the restoration force of the spring 700, the cap 500 may return to its original position. Thus, the tip portion of the secondary elongate core 400 may be inserted back in the inner space in the cap 500.

Figure 14:
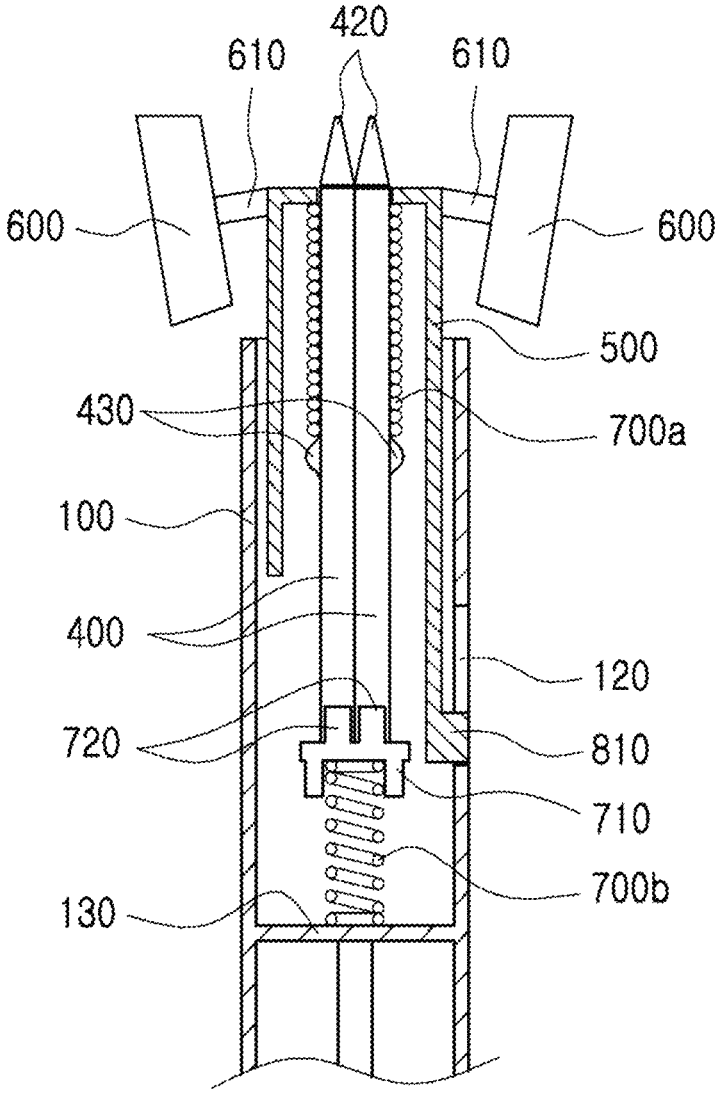
FIG. 14 shows a cross-sectional view of an underline-drawing module of a writing and underline-drawing implement in accordance with an eleventh embodiment of the present discourse.

FIG. 14 shows a cross-sectional view of an underline-drawing module of a writing and underline-drawing implement in accordance with the eleventh embodiment of the present discourse. As shown in FIG. 14, the eleventh embodiment may be different from the fourth to tenth embodiments in that two secondary elongate cores 400 may be disposed side by side where the secondary elongate cores 400 may have different colors rendered.

In this embodiment, the two tip portions of the two secondary elongate cores 400 respectively may protrude out of the cap concurrently. However, when the upper hollow body 100 is tilted, only one of the two tip portions of the two secondary elongate cores 400 respectively may be used to draw one line.

In one embodiment, the secondary elongate core 400 may include a ball pen core. In one embodiment, the secondary elongate core 400 may include a non-ball type highlighter pen core. Since a tip portion of the non-ball type highlighter pen core may be dried due to a long time exposure to the air, a knock type highlighter pen is used. Specifically, in a non-use mode, the tip point of the non-ball type highlighter pen core is hidden. In a use mode, upon pressing of the core controller, an entrance of the tip point is opened, to allow the tip point of the non-ball type highlighter pen core to be extended out to be exposed. Then, upon further pressing of the core controller, the tip point of the non-ball type highlighter pen core to be retracted in to be concealed and then the entrance of the tip point is closed. Such a knock type highlighter pen is disclosed in details in the above patent document 2 and patent document 3, contents of which are incorporated herein by reference.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

The present disclosure may have following industrial abilities. In accordance with the above writing and underline-drawing implement, both the writing and underline-drawing modes may be realized in a single pen. This may improve in-depth studies due to the fact that it may dispense the separate elongate straight object. Further, the present writing and underline-drawing implement may allow the user to quickly draw an underline in a straight line with improved straightness without the separate elongate straight object.

What is claimed is:

1. A writing and underline-drawing implement comprising:

an upper elongate hollow body having an open top portion and a closed bottom portion;

a lower elongate hollow body coupled to the upper hollow body, the lower elongate hollow body having a first tip hole;

a primary elongate core received in the lower hollow body, the primary elongate core having a first tip portion;

a secondary elongate core received in the upper elongate hollow body, the secondary elongate core having the second tip portion, wherein the secondary elongate core has a bottom portion contacting the bottom portion of the upper body;

a cap having a second tip hole partially formed in a top portion thereof, the cap being hollow and having an open bottom portion to partially receive and/or passed through by the secondary elongate core, the cap being inserted into the top portion of the upper elongate hollow body, the cap being configured to at least partially move along a length of the upper elongate hollow body; and rotatable guide wheels coupled to the cap at an upper portion of the cap, the cap being disposed between the guide wheels, wherein the secondary elongate core is configured such that the second tip portion passes through and beyond the second tip hole out of the cap when the cap is further inserted in the upper elongate hollow body by a predetermined distance, thereby to reach an underline-drawing mode where when the guide wheels contact and run on a paper, the second tip portion draws a straight line on the paper.

2. The implement of claim 1, wherein a stopper protrusion is formed on the secondary elongate core at a position downwardly distant from the second tip portion at a predetermined distance, wherein the implement further comprises a spring extended between the cap and the stopper protrusion, wherein the spring is passed through by the secondary elongate core, wherein the spring is configured to push the cap outwardly from the upper body as the cap inserts inwardly into the upper body.

3. The implement of claim 1, wherein the implement further comprises a spring extended between the cap and the bottom portion of the upper hollow body, wherein the spring is passed through by the secondary elongate core space, wherein the spring is configured to push the cap outwardly from the upper body as the cap inserts inwardly into the upper body.

4. The implement of claim 2, wherein the upper hollow body has an elongate stopper hole formed therein, wherein the implement further comprises a stopper including a vertical extension extending downwardly from a bottom of the cap and a stopper protrusion projecting outwardly from a bottom of the vertical extension, the stopper protrusion being integrated with the vertical extension, the stopper protrusion being configured to move vertically in and along the elongate stopper hole, wherein the stopper is configured such that when the stopper protrusion reaches a top of the elongate stopper hole, the cap stops from upward movement.

5. The implement of claim 2, wherein the upper hollow body has an upper elongate stopper hole and lower elongate stopper hole which are spaced vertically from each other, wherein the implement further comprises a stopper including:

a vertical extension extending downwardly from a bottom of the cap, wherein the vertical extension is configured to move inwardly or outwardly in an elastic manner;

a lower stopper protrusion projecting outwardly from a bottom of the vertical extension, the stopper protrusion being integrated with the vertical extension, the stopper protrusion being configured to move vertically in and along the lower elongate stopper hole; and an upper stopper protrusion projecting outwardly from the vertical extension, the upper stopper protrusion being integrated with the vertical extension, the upper stopper protrusion being configured to move vertically in and along the upper elongate stopper hole, wherein the upper stopper protrusion is spaced vertically from the lower stopper protrusion, wherein the stopper is configured such that when the lower stopper protrusion reaches a bottom of the lower elongate stopper hole, the upper stopper protrusion reaches a top of the lower elongate stopper hole, thereby stop the cap from upward movement;

wherein the stopper is configured such that when the lower stopper protrusion is pushed inwardly to allow the upper stopper protrusion to overcome the upper hollow body at the top of the lower elongate stopper hole and, then, the upper stopper protrusion is engaged into the upper elongate stopper hole and at the same time, the lower stopper protrusion reaches the top of the lower elongate stopper hole.

6. The implement of claim 1, wherein the secondary elongate core includes a ball-pen core.

7. The implement of claim 1, wherein the secondary elongate core includes a non-ball type highlighter pen core, wherein when the second tip portion of the secondary elongate core is hidden in the cap, the second tip hole is blocked.

8. The implement of claim 1, wherein the secondary elongate core includes two parallel-adjacent secondary elongate cores to render different colors from each other.

9. The implement of claim 3, wherein the upper hollow body has an elongate stopper hole formed therein, wherein the implement further comprises a stopper including a vertical extension extending downwardly from a bottom of the cap and a stopper protrusion projecting outwardly from a bottom of the vertical extension, the stopper protrusion being integrated with the vertical extension, the stopper protrusion being configured to move vertically in and along the elongate stopper hole, wherein the stopper is configured such that when the stopper protrusion reaches a top of the elongate stopper hole, the cap stops from upward movement.

10. The implement of claim 3, wherein the upper hollow body has an upper elongate stopper hole and lower elongate stopper hole which are spaced vertically from each other, wherein the implement further comprises a stopper including:

a vertical extension extending downwardly from a bottom of the cap, wherein the vertical extension is configured to move inwardly or outwardly in an elastic manner;

a lower stopper protrusion projecting outwardly from a bottom of the vertical extension, the stopper protrusion being integrated with the vertical extension, the stopper protrusion being configured to move vertically in and along the lower elongate stopper hole; and an upper stopper protrusion projecting outwardly from the vertical extension, the upper stopper protrusion being integrated with the vertical extension, the upper stopper protrusion being configured to move vertically in and along the upper elongate stopper hole, wherein the upper stopper protrusion is spaced vertically from the lower stopper protrusion, wherein the stopper is configured such that when the lower stopper protrusion reaches a bottom of the lower elongate stopper hole, the upper stopper protrusion reaches a top of the lower elongate stopper hole, thereby stop the cap from upward movement;

wherein the stopper is configured such that when the lower stopper protrusion is pushed inwardly to allow the upper stopper protrusion to overcome the upper hollow body at the top of the lower elongate stopper hole and, then, the upper stopper protrusion is engaged into the upper elongate stopper hole and at the same time, the lower stopper protrusion reaches the top of the lower elongate stopper hole.

11. A writing and underline-drawing implement comprising:

an elongate hollow body having an open top portion and a closed bottom portion;

an elongate core received in the elongate hollow body, the elongate core having the tip portion; wherein the elongate core has a bottom portion spaced from the bottom portion of the body;

a cap having a tip hole partially formed in a top portion thereof, the cap being hollow and having an open bottom portion to partially receive and/or passed through by the elongate core, the cap being inserted into the top portion of the elongate hollow body, the cap being configured to at least partially move along a length of the elongate hollow body; and rotatable guide wheels coupled to the cap at an upper portion of the cap, the cap being disposed between the guide wheels, wherein the elongate core is configured such that the tip portion passes through and beyond the tip hole out of the cap when the cap is further inserted in the elongate hollow body by a predetermined distance, thereby to reach an underline-drawing mode where when the guide wheels contact and run on a paper, the tip portion draws a straight line on the paper.

12. The implement of claim 11, wherein the implement further comprises:

a spring support in the hollow body to be coupled to a bottom of the core;

a stopper protrusion formed on the elongate core at a position downwardly distant from the tip portion at a predetermined distance;

an upper spring extended between the cap and the stopper protrusion, wherein the spring is passed through by the secondary elongate core; and a lower spring extended between the stopper protrusion and the bottom portion of the body.

13. The implement of claim 11, wherein the implement further comprises:

a spring support in the hollow body to be coupled to a bottom of the core, wherein the spring support has a coupling protrusion engaged into a coupling groove formed in the bottom portion of the core;

a stopper protrusion formed on the elongate core at a position downwardly distant from the tip portion at a predetermined distance;

an upper spring extended between the cap and the stopper protrusion, wherein the spring is passed through by the secondary elongate core; and a lower spring extended between the stopper protrusion and the bottom portion of the body.

14. The implement of claim 11, wherein the hollow body has an elongate stopper hole formed therein, wherein the implement further comprises a stopper including a vertical extension extending downwardly from a bottom of the cap and a stopper protrusion projecting outwardly from a bottom of the vertical extension, the stopper protrusion being integrated with the vertical extension, the stopper protrusion being configured to move vertically in and along the elongate stopper hole, wherein the stopper is configured such that when the stopper protrusion reaches a top of the elongate stopper hole, the cap stops from upward movement.

15. The implement of claim 11, wherein the hollow body has an upper elongate stopper hole and lower elongate stopper hole which are spaced vertically from each other, wherein the implement further comprises a stopper including:

a vertical extension extending downwardly from a bottom of the cap, wherein the vertical extension is configured to move inwardly or outwardly in an elastic manner;

a lower stopper protrusion projecting outwardly from a bottom of the vertical extension, the stopper protrusion being integrated with the vertical extension, the stopper protrusion being configured to move vertically in and along the lower elongate stopper hole; and an upper stopper protrusion projecting outwardly from the vertical extension, the upper stopper protrusion being integrated with the vertical extension, the upper stopper protrusion being configured to move vertically in and along the upper elongate stopper hole, wherein the upper stopper protrusion is spaced vertically from the lower stopper protrusion, wherein the stopper is configured such that when the lower stopper protrusion reaches a bottom of the lower elongate stopper hole, the upper stopper protrusion reaches a top of the lower elongate stopper hole, thereby stop the cap from upward movement;

wherein the stopper is configured such that when the lower stopper protrusion is pushed inwardly to allow the upper stopper protrusion to overcome the hollow body at the top of the lower elongate stopper hole and, then, the upper stopper protrusion is engaged into the upper elongate stopper hole and at the same time, the lower stopper protrusion reaches the top of the lower elongate stopper hole.

16. The implement of claim 11, wherein the cap has a cap protrusion disposed in a ring shape at a bottom end thereof to protrude outwardly, wherein the hollow body has two body protrusions formed on an inner face thereof which are vertically spaced from each other, wherein each of the two body protrusions protrude inwardly in a ring shape, wherein the hollow body has a position limiter protrusion formed on an inner face thereof below the lower body protrusion at a given distance, wherein the position limiter protrusion protrudes inwardly in a ring shape, wherein via application of an external force above a given degree to the cap protrusion and body protrusions, the cap protrusion overcomes the body protrusion partially due to a rounded shape thereof, wherein the position limiter protrusion stops the movement of the cap protrusion partially due to an angled shape thereof, wherein when the cap protrusion is fitted between in the lower body protrusion and the position limiter protrusion, the cap is fixed in a position while the tip portion is exposed outwardly.

17. The implement of claim 11, wherein the hollow body has an elongate stopper hole formed therein, wherein the implement further comprises a stopper including a vertical extension extending downwardly from a bottom of the cap and a stopper protrusion projecting outwardly from a bottom of the vertical extension, the stopper protrusion being integrated with the vertical extension, the stopper protrusion being configured to move vertically in and along the elongate stopper hole, wherein the stopper is configured such that when the stopper protrusion reaches a top of the elongate stopper hole, the cap stops from upward movement, wherein the cap has a cap protrusion disposed in a ring shape at a bottom end thereof to protrude outwardly, wherein the hollow body has a body protrusion formed on an inner face thereof, wherein the body protrusion protrudes inwardly in a ring shape;

wherein the hollow body has a position limiter protrusion formed on an inner face thereof below the lower body protrusion at a given distance, wherein the position limiter protrusion protrudes inwardly in a ring shape, wherein via application of an external force above a given degree to the cap protrusion and body protrusions, the cap protrusion overcomes the body protrusion partially due to a rounded shape thereof, wherein the position limiter protrusion stops the movement of the cap protrusion partially due to an angled shape thereof, wherein when the cap protrusion is fitted between in the lower body protrusion and the position limiter protrusion, the cap is fixed in a position while the tip portion is exposed outwardly.

18. The implement of claim 11, wherein two elongate stopper holes are formed to be spaced vertically from each other in a side portion of the hollow body, wherein the two elongate stopper holes include upper elongate stopper hole and lower elongate stopper holes, wherein the instrument further comprises a stopper extending downwardly to be coupled to a bottom end of the cap, wherein the stopper has a stopper protrusion projecting from a bottom end thereof and the stopper protrusion moves inwardly or outwardly in an elastic manner and the stopper protrusion vertically moves while engaged into the upper elongate stopper hole and is fixed in a position when engaged into the lower elongate stopper hole, wherein the stopper protrusion protrudes from the stopper outwardly, wherein the stopper is configured such that when the stopper protrusion vertically moves while engaged into the upper elongate stopper hole and reaches a top or bottom of the upper elongate stopper hole, the first stopper protrusion stops there, and, thus, the cap also stops there, wherein the stopper is configured such that when the stopper protrusion overcomes the hollow body and goes downs into the lower elongate stopper hole, the stopper protrusion stops there, and, thus, the cap also stops there.

19. The implement of claim 11, wherein each of the guide wheels has a truncated conical shape, and a shaft of each of the guide wheels extends to tilt toward the body.

20. The implement of claim 11, wherein the elongate core includes a ball-pen core.

21. The implement of claim 11, wherein the elongate core includes a non-ball type highlighter pen core, wherein when the tip portion of the elongate core is hidden in the cap, the tip hole is blocked.

22. The implement of claim 11, wherein the elongate core includes two parallel-adjacent elongate cores to render different colors from each other.

* * * * *